US005342818A

United States Patent [19]

Imai et al.

[11] Patent Number: 5,342,818

[45] Date of Patent: Aug. 30, 1994

[54] THERMAL DYE TRANSFER PRINTING METHOD, INTERMEDIATE MEDIA AND TRANSFER MEDIA THEREFOR

[75] Inventors: Akihiro Imai, Ikoma; Hiroyuki Matsuo, Neyagawa; Yasuo Fukui, Kadoma; Soichiro Mima, Nishinomiya; Nobuyoshi Taguchi, Ikoma, all of Japan

[73] Assignee: Matsushita Electric Industrial Co., Ltd., Osaka, Japan

[21] Appl. No.: 946,856

[22] Filed: Sep. 18, 1992

[30] Foreign Application Priority Data

Sep. 18, 1991 [JP] Japan ..... 3-237698

[51] Int. Cl.[5] ..... B41M 5/035; B41M 5/38

[52] U.S. Cl. ..... 503/227; 156/235; 156/239; 156/240; 428/195; 428/913; 428/914

[58] Field of Search ..... 8/471; 428/195, 913, 428/914; 503/227; 156/235, 239, 240

[56] References Cited

U.S. PATENT DOCUMENTS 5,006,502 4/1991 Fujimura et al. ..... 503/227

FOREIGN PATENT DOCUMENTS 238056 2/1990 Japan ..... 503/227
3-45390 2/1991 Japan ..... 503/227
3-53986 3/1991 Japan ..... 428/195

*Primary Examiner*—B. Hamilton Hess
*Attorney, Agent, or Firm*—Wenderoth, Lind & Ponack

[57] ABSTRACT

The present invention provides a thermal transfer printing method, an intermediate medium and a transfer medium therefor, which make it possible to obtain printed image having deep color and high light resistance without back diffusion of dye.

The method of the present invention comprises:

transferring each color image by a printing head from a transfer medium A onto an intermediate medium wherein said transfer medium A has at least one color ink block consisting of color ink layers each of which contains different color ink, said intermediate medium has image receiving layers, whereby each image receiving layer on the intermediate medium contains one color image, and transferring each color image receiving layer onto an imaging sheet from the intermediate medium, so that a same image receive portion of the imaging sheet contains the image receiving layers corresponding to one color ink block.

15 Claims, 9 Drawing Sheets

THERMAL DYE TRANSFER PRINTING METHOD, INTERMEDIATE MEDIA AND TRANSFER MEDIA THEREFOR

FIELD OF THE INVENTION

The present invention relates to a novel thermal transfer printing method using a thermal head, a light head (e.g. a laser head) and an electrode head, as well as an intermediate medium and a transfer medium therefor. More particularly, it relates to a thermal transfer printing method, an intermediate medium and a transfer medium therefor, which make it possible to obtain printed image having deep color and high light resistance without back diffusion of dye.

BACKGROUND OF THE INVENTION

Thermal transfer printing using a sublimable dye is a method wherein a transfer medium, which comprises a substrate and a color ink layer thereon, is directly contacted on an image receive sheet and heated by a recording head to heat-transfer the color material or the color ink layer onto the image receive sheet. If full color images are required, a portion of the image receive sheet is subjected to heat transferring three times with each color ink layers, such as cyan, magenta and yellow. If necessary, a black color ink layer is also used to record.

Among heat transfer recording, the use of a sublimable dye provides heat-transferred images similar to the image obtained by using silver salt, but they lack depth (flat image). The printed images also have poor light resistance. Especially, since the recorded image contains three color dyes in mixing form, catalytic fading happens. Also if cyan was recorded on magenta, the magenta image might be retransferred onto the transfer madium and the recording concentration of magenta reduces. The retransferring amount is varied by recording energy and number of transferring steps, thus the recorded images is deteriorated in uniformity. The melting type heat transfer also provides flat image and, when dye is used, has poor light resistance. The retransferring phenomenon may also occur in this method.

SUMMARY OF THE INVENTION

The present invention provides a thermal transfer printing method, an intermediate medium and a transfer medium therefor, which make it possible to obtain printed image having deep color and high light resistance without back diffusion of dye.

The method of the present invention comprises:

transferring each color image by a thermal head from a transfer medium A onto an intermediate medium wherein said transfer medium A has at least one color ink block consisting of color ink layers each of which contains different color ink, said intermediate medium has image receiving layers, whereby each image receiving layer on the intermediate medium contains one color image, and transferring each color image receiving layer onto an imaging sheet from the intermediate medium, so that a same image receive portion of the imaging sheet contains the image receiving layers corresponding to one color ink block.

DETAILED DESCRIPTION OF THE INVENTION

Figure 1:
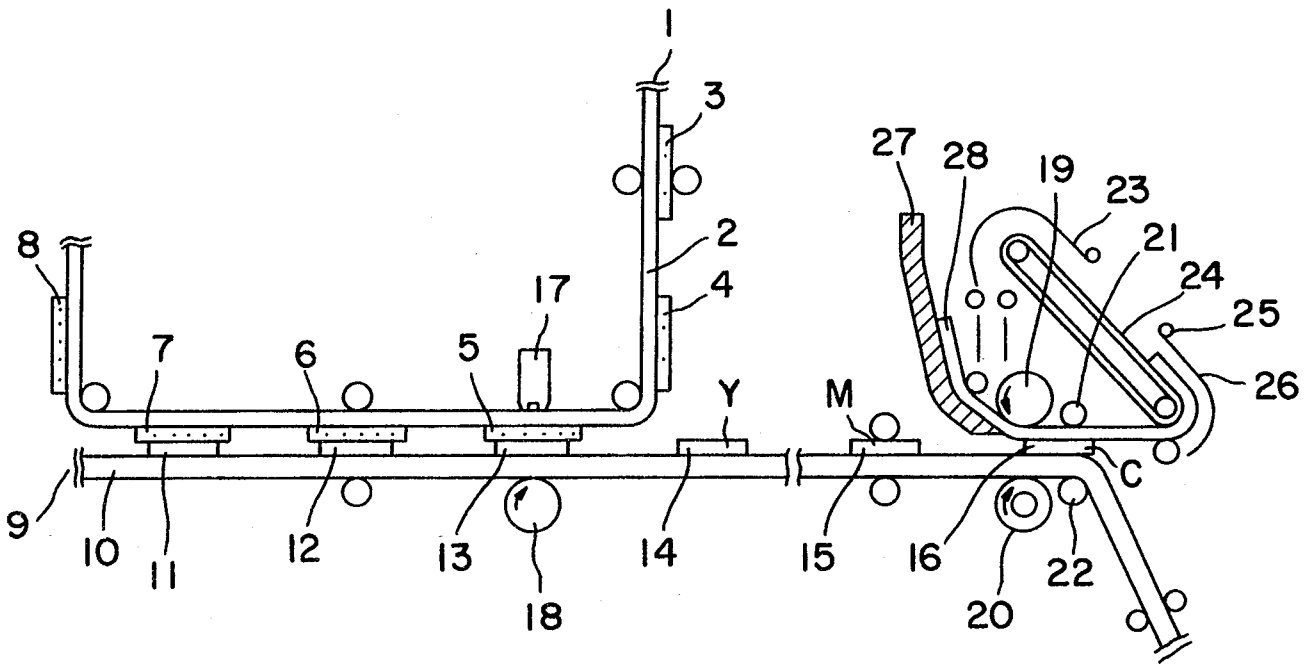
FIG. 1 is a drawing which schematically shows one embodiment of the printing method of the present invention.

The first embodiment is explained with referring FIG. 1. The transfer medium A has at least one color ink block X consisting of color ink layers, each of which contains different color ink. In FIG. 1, the transfer medium A comprises a substrate 2 and color ink layers 3–8 thereon (i.e. magenta color ink layer 3, yellow color ink layer 4, cyan color ink layer 5, magenta color ink layer 6, yellow color ink layer 7 and cyan color ink layer 8). One color ink block means one repeating unit of color ink layers, so that in FIG. 1, three color ink layers of magenta, cyan and yellow constitute one color ink block X.

In FIG. 1, the intermediate medium 9 comprises a substrate 10 and image receiving layers 11–16. The image receiving layers can be a continuous layer if possible. In FIG. 1, the transfer medium A is heaped on the intermediate medium 9, such that each color ink layer is contacted with each image receiving layer.

The transfer medium A and the intermediate medium 9 are moved between the recording head 17 and a platen 18. The transferring of image is conducted such that one color image is transferred onto one image receiving layer. In FIG. 1, the cyan color ink layer 5 is contacted with the image receiving layer 13 and moved between the recording head 17 (e.g. a thermal head) and the platen 18 under a suitable pressure, while the recording head 17 heats the color ink layer 5 in accordance with recording information to record a cyan image on the image receiving layer 13. If the color ink layer contains sublimable or dispersible dye, the dye is sublimated or dispersed onto the image receiving layer. If the color ink layer is heat melting, at least a portion of the color ink layer is transferred onto the image receiving layer to form an image. Then, the magenta color ink layer 6 and the image receiving layer 12 is moved between the recording head 17 and the platen 18 by moving the transfer medium A and the intermediate medium 9 and the same magenta image transferring is conducted as generally described above. Then, yellow image is formed by the yellow color ink layer 7 and the image receiving layer 11.

FIG. 1 shows an embodiment of three colors, but the transfer medium A may have color ink layers of 2, 4 or more colors. The recording head 17 may be located on the side of the intermediate medium 9 and the platen 18 may be located on the side of the transfer medium A. The head and/or platen is either fixed or moved.

The movement of the transfer medium A and the intermediate medium 9 is not limited to right direction as described in FIG. 1. For example, between the recording head 17 and the platen 18, the transfer medium A and the intermediate medium 9 may drive in the same direction or opposite direction, or may drive at different speeds. The recording head is not limited as long as the color dye is sublimated or diffused onto the receiving layer or the color ink layer is transferred onto the receiving layer. Examples of the printing heads are a thermal head, an electrode head, a light head and the like. Number of the recording heads is not limited, and three recording heads may be employed and one color is charged in one head.

In the above embodiment, three color ink layers and three image receiving layers are employed for three colors, but this is not necessary. For example, one image receiving layer may receive two or more color images from two or more color ink layers. This relation may be the same as hereinafter explained embodiments.

The intermediate medium 9 imaged as mentioned above is send to contact with with an imaging sheet 28 (e.g. a sheet of plain paper) which is provided by an imaging sheet guide 27, so that the cyan image receiving layer is in contact with with the surface of the imaging sheet 28. After applying a suitable pressure and/or heat by, for example, between a heat roller 19 and a heated silicone rubber roller 20, the cyan image receiving layer is released from the substrate 10 and transferred onto the imaging sheet 28 to form the cyan image on the imaging sheet 28.

The imaging sheet 28 having the cyan image is sent between the heat roller and heated silicone rubber roller by a transmitting guide 26, a transmitting belt 24 and a transmitting guide 23 (if necessary the sheet 28 may be electrostatically adhered onto the belt), while the magenta image receiving layer 15 is also moved between the heat roller and heated silicone rubber roller. The transferring process of the magenta image is conducted as generally described above, after adjusting the cyan image portion of the sheet 28 to the magenta image. The third color (yellow) image is also formed as described above. The transmitting guide 26 is gone up and the imaging sheet 28 is taken out to obtain a full color printed imaging sheet 28.

Needless to say, the recording head 17, the platen roller 18, the heat roller 19 and the heated silicone rubber roller may be movable according to the movement of the transfer medium A, the intermediate medium 9 and the imaging sheet 28. Also, a driving system between the platen roller 18 and the heated silicone rubber roller 20 is omitted in FIG. 1, but various rollers, such as pinch rollers, may be present.

If necessary, some sensors for detecting the positions of the color ink layers, the image receiving layers and the imaging sheet may be attached. Also, in FIG. 1, the transmitting system of the imaging sheet 28 can be changed to another system as long as the imaging sheet 28 is returned to the same position for transferring. For example, air flowing transmitting, pressure transmitting or movable (rubber) roller transmitting can be employed.

Heating or pressing may be provided by passing the intermediate medium and the imaging sheet between mediums of which at least one is heated or between mediums which are pressed with each other. Heating may be carried out by a light source which has a high radiant heat. In FIG. 1, the heat roller 19 and the heated silicone rubber roller 20 are employed. The heat roller may be rubber (silicone rubber, fluorine rubber, urethane rubber etc.) covered rollers, plastic rollers, metal rollers, Teflon-coated rollers and the like. The heating or pressing method is not limited as long as the image receiving layer is transferred onto the imaging sheet, but preferred is a combination of rollers of which at least one is a heat roller. More preferred is a combination of a resilient roller (rubber covered roller) and a metal roller under a certain pressure (e.g. a spring or air pressure), or a combination of two resilient rollers. One of the pressure or heat mediums may be a thermal head or an electrode head which transfers only a necessary portion (a printed portion) of the image receiving layers. A temperature of heating is not limited, but generally within the range of room temperature to 300° C. An amount of pressure is not limited, but generally less than $10^8$ Pa.

Transferring of the image receiving layers may be conducted by releasing the intermediate medium from the image receiving layers immediately after passing between the heat roller 19 and the heated silicone rubber roller 20, but they are cooled a certain period of time after passing between the rollers 19 and 20 and then passing between rollers 21 and 22, as shown in FIG. 1.

Hereinafter, the second and subsequent embodiments are explained, but the above mentioned heat and pressure providing methods can be applied. The transferring process can also be applied.

The second embodiment will be explained with referring FIG. 2.

In this embodiment, one or more image receiving layers are heaped on the intermediate medium 9, before transferring them onto the imaging sheet 28. FIG. 2 schematically shows the portion of the intermediate medium wherein the heaping process is conducted. The intermediate medium 9 has been already imaged as described in FIG. 1, and the image receiving layers 14, 15 and 16 have respectively yellow, magenta and cyan images. In FIG. 2, the magenta image receiving layer 15 is transferred onto the cyan image receiving layer 16 to form a heaped image receiving layers. The intermediate medium 9 is turned up by a movable roller 34 and the magenta image receiving layer 15 is heaped on the cyan image receiving layer 16 such that the images are just overlapped. The both heaped layers 15 and 16 are passed between heat rollers 30 and 31, and between rollers 32 and 33, by controlling the movable roller 34 to transfer the magenta image receiving layer 15 onto the cyan image receiving layer 16. Further, the yellow image receiving layer 14 is heaped on the magenta and cyan heaped image receiving layers 15 and 16 by controlling the movable roller 34 and transferring is conducted as mentioned above to form a full color image receiving layers on the intermediate medium 9. The above process is applicable when two colors or four or more colors are used.

In this embodiment, since the image receiving layers are heaped, it is preferred that the adhesive power is different between the image receiving layers or the substrate of the intermediate medium 9. For example, the adhesive power between the substrate 10 and the cyan image receiving layer is stronger than that between the substrate 10 and the magenta image receiving layer 15 or the yellow image receiving layer 13. In addition, the image receiving layer which will be lower layer is formed from a different material in, for example, flow softening temperature, etc., with the other image receiving layer which will be upper layer.

The third embodiment will be explained.

The third embodiment is a subsequent step of the second embodiment. The third embodiment is a post treatment that the intermediate medium is passed between the heat rollers 19 and 20 together with the imaging sheet 28, so that full color image receiving layers are transferred onto the imaging sheet 28.

The fourth embodiment will be explained with referring to FIG. 3.

Figure 3:
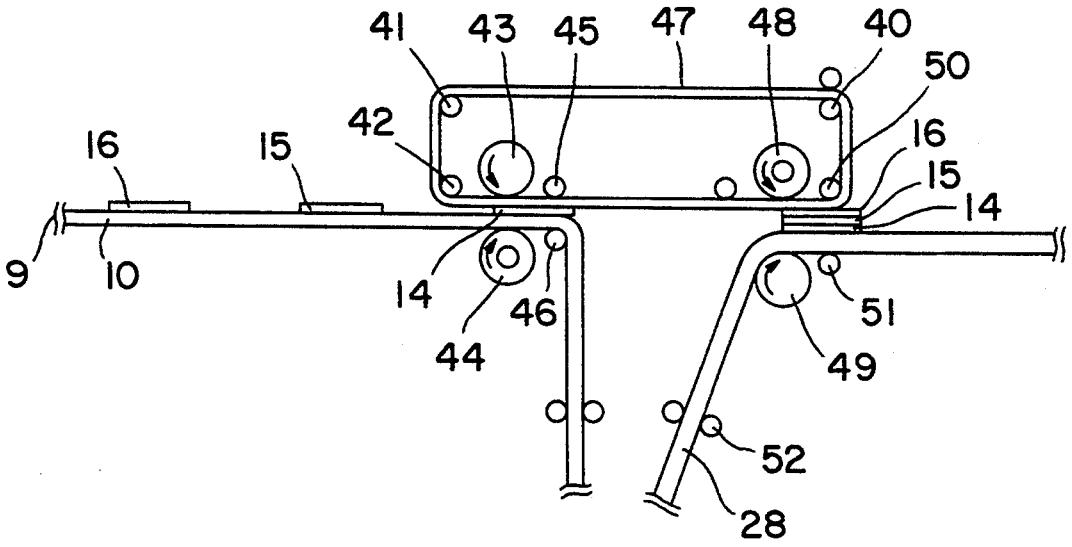
FIG. 3 is a drawing which schematically shows the transferring system in case of using a second intermediate medium.

FIG. 3 shows that the image receiving layers which have been imaged are transferred onto another intermediate medium (second intermediate medium), which is then transferred onto the image sheet 28. In FIG. 3, the intermediate medium 9, which has been imaged as generally described in FIG. 1, has the cyan image receiving layer 16, the magenta image receiving layer 15 and the yellow image receiving layer 14 on the substrate 10.

The second intermediate medium 47 is a rotating belt along rollers 50, 40, 41 and 42. The yellow image receiving layer 14 is contacted with the second intermediate medium 47 under a pressure between a heat roller 43 and a heated silicone rubber roller 44, and the rollers 45 and 46, and the image receiving layer 14 is released from the substrate 10 while transferring onto the second intermediate medium 47. The transferred layer 14 is sent to a heated silicone rubber roller 48 and a heat roller 49 and passed between the roller 48 and 49 and other rollers 50 and 51 while transferring the yellow image receiving layer 14 onto the imaging sheet 28. The image receiving sheet 28 is returned by a driving roller 52, a transmitting belt and the like, after the transferring of the yellow image receiving layer 14. The magenta image receiving layer 15 and cyan image receiving layer 16 are also transferred onto the yellow image receiving layer 14 on the imaging sheet 28 as generally described above. As the result, a full color image receiving layers are formed on the imaging sheet 28. The distance between the image receiving layers on the second intermediate medium 47 is not limited and can be narrowed.

The above embodiment shows that the image receiving layers are transferred one by one, but two image receiving layers may be piled on the second intermediate medium 47 and then transferred onto the imaging sheet 28. In other words, the transferring method may be conducted though any way.

In FIG. 3, the second intermediate medium is in the form of a belt, but can be other forms, such as polymer film, roller and the like. The second intermediate medium may be formed from rubber (e.g. silicone rubber, urethane rubber and fluorine rubber), heat resistant resin (e.g. polyimide, polyamide and polyester resin), or covered therewith.

In order to make it easy to transfer the image receiving layer from the intermediate medium 9 to the second intermediate medium 47, a releasing layer (e.g. silicone resin layer) may be formed between the substrate 10 and the image receiving layers. It is also preferred that the adhesive power of the image receiving layers to the substrate is smaller than that to the image receiving layers to the second intermediate medium 47.

The fifth embodiment of the present invention will be explained with FIGS. 4–6.

The transfer medium B has image receiving layers and color ink layers in different positions. In FIG. 4, the transfer medium 60 has three image receiving layers 64, 65 and 66 and three color ink layers 67, 68 and 69 in this order in the same side. The order of the layers are not limited to the embodiment of FIG. 4 as long as the image receiving layers are faced with the color ink layers, or they can be continuous if possible.

Figure 4:
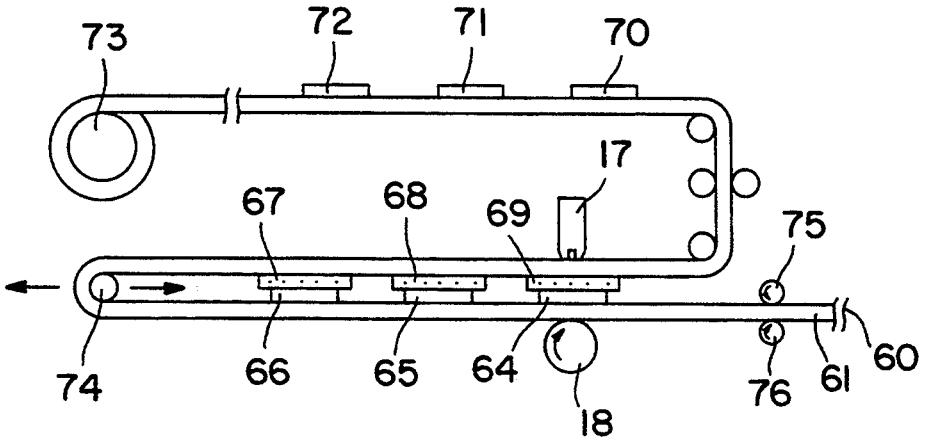
FIG. 4–6 are drawings which schematically shows the transferring method in case of using a transfer medium B

In FIG. 4, the image receiving layer 64 is faced with the cyan color ink layer 69 and passed between a recording head 17 and a platen roller 18 to print an image onto the image receiving layer 64 from the color ink layer according to the recording information. The next combination of the layers 65 and 68 is moved to the position between the recording head 17 and the platen roller by to print a magenta image. The same operation is conducted to print an yellow image. In FIG. 4, the image receiving layers and the color ink layers are driven in the same direction, but are not limited. For example, the layers can go opposite direction. The relative speed of the layer may be changed.

Figure 5:
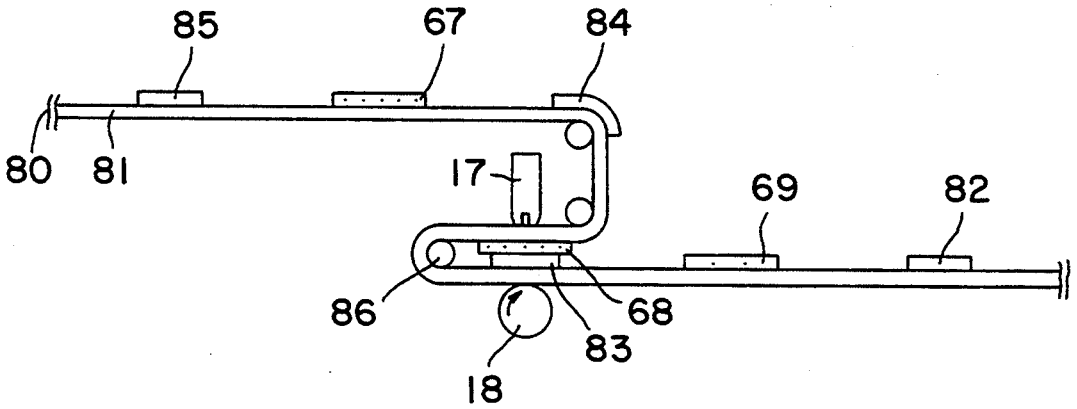

FIG. 5 shows another embodiment in which a transfer medium 80 has image receiving layers and color ink layers alternately 85, 67, 84, 68, 83, 69 and 82. The printing is conducted by, for example, facing the magenta color ink layer with the image receiving layer and passing it between the recording head 17 and the platen roller 18. The next printing is conducted by facing the yellow color ink layer 67 with the image receiving layer 84 and passing between the recording head 17 and the platen roller 18. A cyan image is printed in the same manner.

Figure 6:
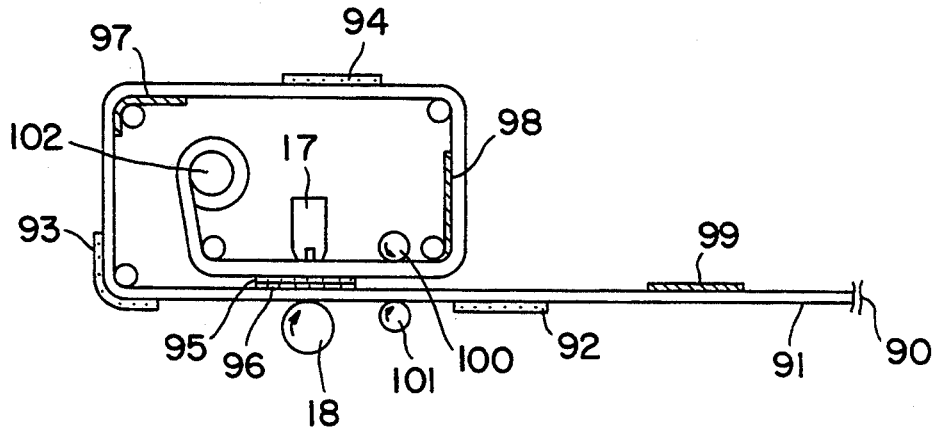

FIG. 6 shows another embodiment in which a transfer medium 90 has color ink layers 92, 93 and 94 in one side of a substrate 91 and image receiving layers 96, 97, 98 and 99 in the other side of the substrate 91. The color ink layers can be faced with the image receiving layers by winding the transfer medium B spirally and passed between the recording head 17 and the platen roller 18. In this embodiment, the transfer medium 90 starts from a winding roller 102 and spirally moves by driving rollers 100 and 101.

Figure 2:
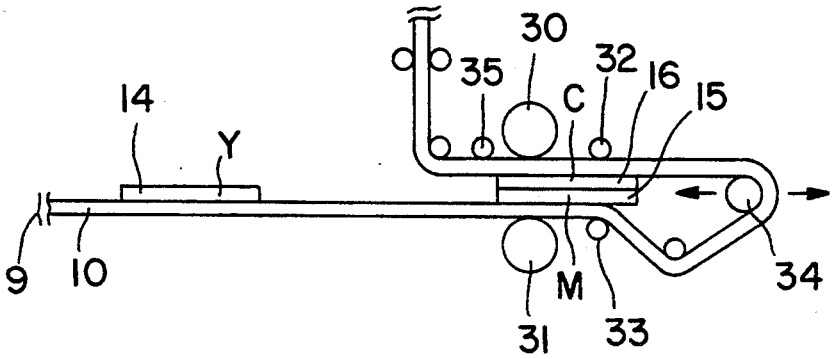
FIG. 2 is a partial schematic drawing which shows a laminating method of the image receiving layers.

Above FIGS. 4–6 show different embodiments of the color ink layers and the image receiving layers and the the other processes may be conducted in the same manner as shown in FIGS. 1–3.

Figure 7:
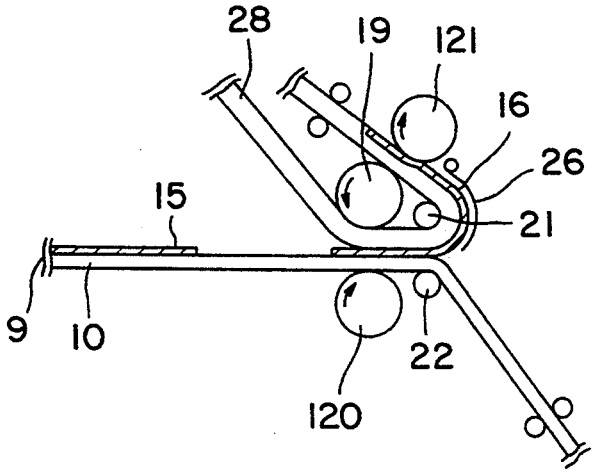
FIG. 7 and 8 are drawings which schematically show a transferring and fixing of the printing method of the present invention.
Figure 8:
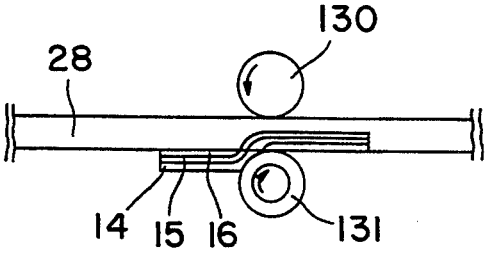

FIG. 7 shows another embodiment of the transferring and fixing process of the transferred image receiving layers on the imaging sheet 28 and FIG. 8 shows another embodiment of the fixing process thereof.

FIG. 7 shows an embodiment in which the heat roller 19 is commonly functioned as one of the fixing rollers to reduce the number of rollers, because the number of rollers increases when the heat roller is different from the fixing roller. Thus, in FIG. 7, the heat roller 19 and the silicone rubber-covered roller 120 constitutes the roller combination of the transferring portion, and the heat roller 19 and the silicone rubber-covered roller 121 constitutes the roller combination of the fixing portion.

In FIGS. 1–7, the printing layer is directly formed on the substrate, but a releasing layer or a polymer material layer or the both may be present between the substrate and the printing layer. The same process can be applied to these plural layers construction.

FIG. 8 is a drawing which schematically shows the fixing process on the imaging sheet of another embodiment of the method of the present invention. The imaging sheet 28 has a laminate of the cyan, magenta and yellow image receiving layers 16, 15 and 14 and then pressured by a heat roller 130 and a silicone rubber-covered heat roller 131 to fix on the imaging sheet 28.

In FIGS. 7 and 8, the combination of a heat roller and a silicone rubber-covered roller is employed, but it is not limited. Also, in this embodiment, rollers are employed, but they are not limited as long as the image receiving layer is transferred onto the imaging sheet by heat and/or pressure. For example, the imaging sheet is passed between mediums of which at least one is heated or between mediums which are pressed with each other. Also, a sucking medium may be provided on the side of the image receive sheet. Heating may be carried out by a light source which has a high radiant heat. The rollers or heat rollers may be rubber (silicone rubber, fluorine rubber, urethane rubber etc.) covered rollers, plastic rollers, metal rollers, Teflon-coated rollers and the like. The heating or pressing medium also can have plate like shape and may be a heat printing head. Heating may be conducted with a various heating medium, such as a halide lamp, a nichrome wire and the like. The combination of two rollers of which at least one roller is heated by for example a halide lamp and pressured is preferred. The heating or pressing method is as the same as FIG. 1. A temperature of heating is not limited, but generally within the range of room temperature to 300° C. An amount of pressure is not limited, but generally less than $10^8$ Pa.

Figure 9:
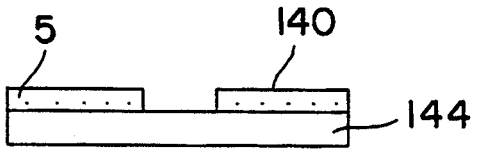
FIGS. 9–11 are sectional views which schematically show several embodiments of the transfer medium A of the present invention.
Figure 10:
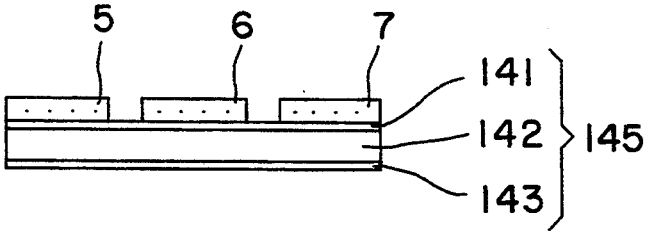
Figure 11:
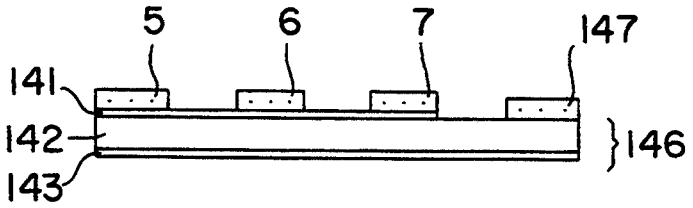

FIGS. 9 to 11 show sectional view of the transfer medium A of the present invention. The transfer medium A comprises at least a substrate 144 and plural color ink layers 5 (cyan) and 140 (black). The color ink layers can be either sublimable or heat-meltable, or the both. FIG. 11 shows that the color ink layers 5, 6 and 7 are sublimable and the color ink layer 147 is heat meltable. By the "sublimable color ink layer" is meant that the dye in the color ink layer is transferred onto an image receiving layer by sublimation or diffusion in the action of heat. In FIG. 10, the transfer medium A has a polymer film 142, an anchor coat layer 141 present on the one side of the polymer film and a lubricant heat resistant layer 143 present on the other side, which forms a substrate 145. On the anchor coat layer 141, the color ink layers (cyan, magenta and yellow) are present.

The substrate 144 can be formed from a material which is known to the art, including a polymer film, a surface treated polymer film, an electroconductive film and the like. Examples of the polymer films are polyolefin, polyamide, polyester, polyimide, polyether, cellulose, poly(parabanic acid), polyoxadiazole, polystyrene, fluorine-containing film and the like. Preferred are polyethylene terephthalate, polyethylene naphthalate, aromatic polyamide, triacetyl cellulose, poly(parabanic acid), polysulfone, polypropylene, cellophane, moistureproof cellophane and polyethylene. It is preferred that at least one side of the substrate is covered with a heat resistance layer, a lubricant layer (or a lubricant electroconductive layer) and a lubricant heat resistance layer (or a lubricant heat resistance electroconductive layer) to enhance heat resistance and traveling stability of the color ink film. For example, as shown in FIG. 10, the substrate 145 may have a lubricant heat resistance layer 143 on one side and an anchor coat layer 141 on a portion of the other side. The lubricant heat resistance layer 143 enhances a traveling stability between the printing head (e.g. a thermal head) and the color ink film and the anchor coat layer 141 enhances an adhesive properties between the polymer film 142 and the color ink layers.

Examples of the electroconductive films are a polymer film containing electroconductive particles (e.g. carbon black or metal powder), a polymer film on which an electroconductive layer is formed, a polymer film on which and electroconductive vapor deposition layer is formed, and the like. In case of the recording head being an electrode head, the electroconductive film is necessary.

The thickness of the substrate is not limited, but generally within the range of 2 to 30 micrometer. The thinner the thickness of the substrate, the better, if there are no problems in treatment. The thin substrate enhances printing sensitivity and increases a color ink film content in a film cassette.

The color layer is mainly composed of a color stuff and a binder. The color stuff is not limited, including a disperse dye, a basic dye, a color former and the like. The binder includes acryl resins, styrene resins, urethane resins, polyester resins, polyvinyl acetal resins, vinyl acetate resins, chlorinated resins, amide resins, cellulose resins and the like. Examples of the cellulose resins are methyl cellulose, ethyl cellulose, hydroxyethyl cellulose, carboxymethyl cellulose, nitrocellulose, acetic cellulose, carboxymethyl cellulose, nitrocellulose, acetic cellulose and the like. Preferred binders are acrylonitrile-styrene copolymer, polystyrene, styrene-acryl copolymer, saturated polyester, polyester-urethane, vinyl chloride resin, chlorinated vinylchloride resin, vinyl chloride-vinyl acetate copolymer (which is further copolymerized with vinyl alcohol, maleic acid and the like), vinyl chloride-acrylate copolymer (of which acrylate may be a mixture), vinyl acetate resin, rubber chloride, polyvinyl acetate, chlorinated polypropylene, polycarbonate and cellulose resins, because printing sensitivity is high and they effectively prevent the color layer from fusing. The copolymer may be prepared from three monomers. The binder or the image receiving layer may also be polyvinyl acetals, such as polyvinyl formal, acetoacetalized polyvinyl alcohol, propionacetalized polyvinyl alcohol, polyvinyl butyral and the like. It is preferred that the binder has a glass transition temperature of 40° to 180° C. and an average polymerization degree of 200 to 3,000.

The color layer may further contain fluorine-containing moisture curable resins or siloxane-containing moisture curable resins to prevent heat fusing. The fluorine-containing moisture curable resins or siloxane-containing moisture curable resins include moisture curable resins which contain hydrolyzable silyl groups (see Japanese Patent Application Ser. No. 144241/1988); and moisture curable resins which contain hydrolyzable isocyanate groups into which fluorine or silicone is introduced. The fluorine-containing moisture curable resins include fluorine-containing polymer having hydrolyzable silyl groups, for example moisture curable resins as described in Japanese Kokai Publication 558/1987, especially fluorine-containing acrylsilicon resin; or fluorine-containing polyurethane resin having hydrolyzable isocyanate group at terminals or side chains. The siloxane-containing moisture curable resins includes siloxane-containing vinyl polymers having hydrolyzable silyl groups, especially siloxane-containing acryl silicon resins; or siloxane-containing polyurethane resins having hydrolyzable isocyanate groups at terminals or side chains. The fluorine-containing moisture curable resins or siloxane-containing moisture curable resins may be modified with urethane resins. Examples of the fluorine-containing acryl silicon resins are fluorine-containing acryl silicon resins available from Sanyo Chemical Industries Ltd. as F-2A. Examples of the siloxane-containing acryl silicon resins are siloxane-containing acryl silicon resin available from Sanyo Chemical Industries Ltd. as F-6A. Examples of the siloxane-containing moisture curable resins having hydrolyzable isocyanate groups are siloxane-containing moisture curable resins available from Shinko Technical Research CO., LTD. as SAT-300P.

The color layer may further contain a reaction promoter for the moisture curable resin, if necessary. Examples of the reaction promoters are titanates (e.g. alkyl titanate), amines (e.g. dibutylamine-2-hexoate), organic tin compounds (e.g. tin octylate, dibutyltin dilaurate, dibutyltin maleate), acidic compounds and catalysts as described in Japanese Kokai Publication 19361/1983. An amount of the reaction polymer is within the range of 0.001 to 100% by weight based on the amount of the resin.

The color layer may also contain a storage stabilizer in case where the moisture curable resin is used as a coating composition. Examples of the storage stabilizers are as described in Japanese Kokai Publication 51724/1985 and 147511/1982.

The color layer may also contain silicone or fluorine materials or antistatic agents.

The color layer is composed of plural layers. Also, a lubricating layer or the other layer may be formed on the color layer. The uppermost layer may preferably contain the fluorine-containing moisture curable resins, siloxane-containing moisture curable resins, or the other silicone or fluorine materials or antistatic agents.

FIGS. 12–16 show sectional views of the intermediate mediums. The intermediate medium at least comprises a substrate and image receiving layers.

Figure 12:
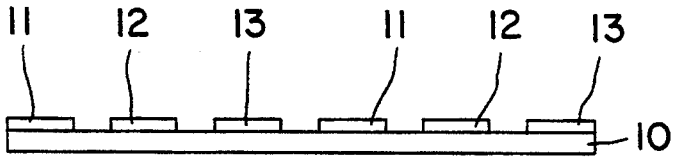
FIGS. 12–16 are sectional views which schematically show several embodiments of the intermediate medium of the present invention.
Figure 13:
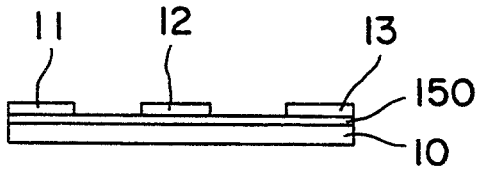
Figure 14:
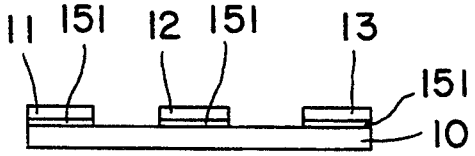
Figure 15:
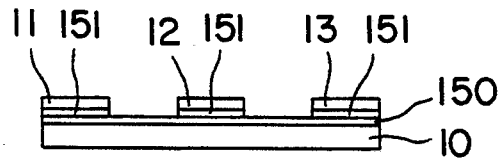

For example, FIG. 12 shows one embodiment of the intermediate medium which is composed of a substrate 10 and thereon image receiving layers 11, 12 and 13 in this order which are repeatedly formed. The image receiving layers can be formed either from the same material or changed by the color dyestuffs which will be received by the layers. For example, the layer 11 is formed for cyan, the layer 12 is for magenta and the layer 13 is for yellow. Number of the image receiving layers generally equals to the number of the color ink layers, but are not limited and can be either fewer or more than it. The image receiving layer may be a continuous layer. The intermediate medium may be, as shown in FIG. 13, composed of a substrate 10, a releasing layer 150 thereon and the image receiving layers 11, 12 and 13. As shown in FIG. 14, a polymer material layer 151 may be inserted between the substrate 10 and the image receiving layers 11, 12 and 13. Also as shown in FIG. 15, both polymer material layer 151 and releasing layer 150 may be present between the substrate 10 and the image receiving layer 11, 12 and 13. The releasing layer 150 or the polymer material layer 151 can be a continuous layer. If possible, some of the image receiving layers are present directly on the substrate 10 and the others are present on it through the releasing layer 150.

Figure 16:
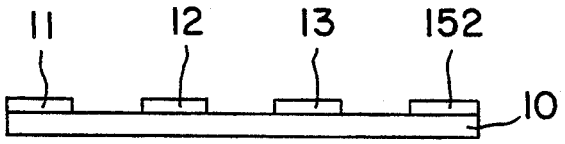

The intermediate medium of the present invention, as shown in FIG. 16, may have a functional layer 152 in addition to the image receiving layers 11, 12 and 13. The functional layer 152 generally has functions to protect the printed images or to promote printed image quality and may therefore by a polymer layer containing ultraviolet absorber, light stabilizer, antioxidant, fluorolescent agent and white hiding agent (e.g. white pigment). The functional layers may be formed from a binder and the additives to provide specific functions. The binder and additives can be the same as those of the image receiving layers, which is explained hereinafter. The functional layers may also be formed on the releasing layer and/or a polymer material layer.

The substrate 10 is not limited and may be a sheet of paper of which surface is smoothening treatment, polymer film and surface-treated polymer film and electroconductive film which are the same as mentioned in the transfer medium A. A thickness of the film is generally within the range of 2 to 100 micrometer, preferably 2 to 30 micrometer. The film can be treated as generally described in the substrate of the transfer medium A.

The image receiving layer is generally formed from polymer material and may contain a color developer, such as an electron accepting material if the color layer contains a leuco dye. Examples of the electron accepting materials are phenols (e.g. bisphenol A), carboxylic compounds, silica, activated clay and the like. The polymer material for the printing layer can be the same as explained for the binder of the color layer, including acryl resin, styrene resin, urethane resin, polyester resin, polyvinyl acetal, vinyl acetate, amide resin, cellulose resin, chlorinated resin and the like. Preferred resins are acrylonitrile-styrene copolymer resin, polystyrene, styrene-acryl copolymer resin, saturated polyester, polyester-urethane, chlorinated rubber, vinyl chloride resin, chlorinated vinyl chloride resin, vinyl chloride-vinyl acetate resin (which may contain vinyl alcohol, maleic acid and the other monomers), vinyl chloride-acrylate copolymer (in which the acrylate may be a combination of plural acrylates), vinyl acetate resin, polycarbonate, chlorinated polypropylene and cellulose resin, which enhances printing sensitivity and heat-fusion proofing properties with the color layer. It is preferred that the polymer material has a glass transition temperature of 40° to 150° C. and an average polymerization degree of 200 to 2,700. In order to transfer the image receiving layer onto the imaging sheet or to fix the resin of the image ##?receiving layer into the imaging sheet (e.g. porous paper), it is preferred that the polymer material has an average polymerization degree of 1,500 or less or has a flow softening point of 200° C. or less. Since the image receiving layer is transferred onto the imaging sheet, it is desired that the image receiving layer is transparent, thus the polymer material being transparent.

The image receiving layer is preferably prepared from polyvinyl acetal. The polyvinyl acetal is a resin which is prepared by reacting polyvinyl alcohols with aldehydes (e.g. formaldehyde, acetoaldehyde, propionaldehyde, butylaldehyde and the like. Typical examples of the polyvinyl acetals are polyvinyl formal, acetoacetalized polyvinyl alcohol, propionacetalized polyvinyl alcohol, polyvinyl butyral and the like. The polyvinyl acetal has superior drying ability for a disperse dye, because it has polar groups which are acetal constructions. The acetal construction has a hydrogen atom or an alkylidene group which is non-polar groups. It is preferred that the polyvinyl acetal has a high acetalization degree and the alkylidene group has 3 carbon atoms or more., because such polyvinyl acetal effective prevents heat fusion. Also, the polyvinyl acetal having high acetalization degree and an alkylidene group having at least three carbon atoms ha a low glass transition temperature, thus resulting in high printing sensitivity.

The polyvinyl acetal preferably has an average polymerization degree of 2,700 or less, more preferably less than 1,500, in view of printing sensitivity and transferring properties. It is also preferred that the polyvinyl acetal has a flow softening point of 250° C. or less, more preferably 200° C. or less. The flow softening point (or flow beginning temperature) is determined by a flow tester (temperature rise rate=6° C./min, extruding pressure=$9.8\times10^6$ Pa, die=1 mm (diameter×10 mm). The polyvinyl acetal which satisfies the range mentioned above has good printing sensitivity and good transferability to the image receive sheet. Since the polyvinyl acetal which has a higher acetalization degree exhibits a higher heat fusion prevention properties, it is desired that the acetalization degree is 50 mol % or more. It is most preferred that the polyvinyl acetal is polyvinyl butyral which has a butyralization degree of 50 mol % or more, because it has excellent heat fusion preventive properties and printing sensitivity. Suitable polyvinyl butyral is commercially available from Sekisui Chemical Co., Ltd. as BL-1 (butyralization degree=63±3 mol %, flow softening point=105° C.), BL-2 (butyralization degree=63±3 mol %, flow softening point=120° C.), BH-S (butyralization degree=70 mol % or more, flow softening point=160° C.), BM-S (butyralization degree=70 mol % or more, flow softening point=150° C.), BL-S (butyralization degree=70 mol % or more, flow softening point=110° C.), BH-3 (butyralization degree=65±3 mol %, flow softening point=206° C.), BM-2 (butyralization degree=68±3 mol %, flow softening point=140° C.), BM-1 (butyralization degree=65±3 mol %, flow softening point=130° C.), BM-5 (butyralization degree=65±3 mol %, flow softening point=160° C.) and the like. The polyvinyl acetal may be reacted with phenol resin, epoxy compound to form a crosslinked structure.

Since the polyvinyl acetal has poor adhesive properties with polyester film (e.g. polyethylene terephthalate film), it is easily removable from the polyester substrate. However, when printing the printing images on the image receiving layer, the polyvinyl acetal has high heat-adhesion preventive properties for the color ink layer so as to anchor on the substrate. When transferring the image receiving layer onto the imaging sheet, the image receiving layer can be easily transferred. In case where the imaging sheet is plain paper, the resin of the image receiving layer is easily coiled with the fibers of paper. Since the polyvinyl acetal which has a higher acetalization degree exhibits a higher heat fusion prevention properties, it is desired that the binder of the color layer has an acetalization degree of 50 mol % or more. It is most preferred that either the color ink layer or the image receiving layer is formed from polyvinyl butyral and the other is formed from the other polymer material, because it has excellent heat fusion preventive properties. For this purpose, the polymer material preferably is acrylonitrile-styrene copolymer, polystyrene, styrene-acryl copolymer resin, saturated polyester, polyester-urethane, chlorinated rubber, vinyl chloride resin, chlorinated vinyl chloride resin, vinyl acetate resin, vinyl chloride-vinyl acetate resin, vinyl chloride-acrylate resin, polycarbonate, chlorinated polypropylene, cellulose resin and the like.

In addition to the main components, the printing layer may also contain fluorine-containing moisture curable resins or siloxane-containing moisture curable resins to prevent heat fusion. Examples of the fluorine-containing moisture curable resins or siloxane-containing moisture curable resins are the same as mentioned in the color ink layer. The addition of the fluorine-containing moisture curable resins or siloxane-containing moisture curable resins is very preferred, because the heat fusion between the color ink layer and the image receiving layer would not occur.

The releasing layer mainly contains a releasing agent or a combination of the releasing agent and a polymer binder. The releasing agent includes the fluorine-containing moisture curable resins, siloxane-containing moisture curable resins, other silicone releasing agents and fluorine releasing agents. The fluorine-containing moisture curable resins or siloxane-containing moisture curable resins are the same as mentioned above. Typical examples of the other silicone releasing agents are dimethylsilicone oil, phenylsilicone oil, fluorine-containing silicone oil, modified silicone oil (e.g. modified with SiH, silanol, alkoxy, epoxy, amino, carboxyl, alcohol, mercapt, vinyl, polyether, fluorine, higher fatty acid, carnauba, amide or alkylallyl), silicone rubber, silicone resin, silicone emulsion and the like. Typical examples of the other fluorine releasing agents are fluorine resins (e.g. polytetrafluoroethylene, tetrafluoroethylene-perfluoroalkyl vinyl ether copolymer), fluorine rubbers (e.g. vinylidene fluoride-hexafluoropropylene rubber), fluorine surfactants, fluoride carbons, fluorine rubber latex and the like. The releasing agent also includes fatty acid esters, waxes and oils. The polymer binder can be the polymer listed in the polymer material layer. If necessary, an adhesive layer may be disposed between the substrate and the releasing layer.

The polymer material layer 151 is prepared from thermoplastic resins or curable resins by means of heat, light or electron beam. The polymer material includes acryl resins, urethane resins, amide resins, ester resins, cellulose resins, styrene resins and the like. The curable resin includes an acrylate resin, such as polyester acrylate, epoxy acrylate, urethane acrylate, silicone acrylate etc.; an unsaturated cycloacetal compound; or an epoxy compound. It is desired that the resin is water soluble or water dispersible, because these resins are good solvent resistance. Preferred polymer materials are polyvinyl alcohol, polyvinyl alcohol derivatives, cellulose derivatives, modified starch, starch derivatives, chlorinated resin and polycarbonate, because they have good solvent resistance to aromatic hydrocarbons or ketones which are used for the image receiving layer and have poor adhesive properties with polyester films which are typically used for the substrate. Examples of the polyvinyl alcohol derivatives are polyvinyl acetal and the like. Examples of the cellulose derivatives are methyl cellulose, ethyl cellulose, hydroxethyl cellulose, carboxymethyl cellulose, nitrocellulose, acetic cellulose and the like. Examples of the processed starches are oxide starch, enzyme-treated starch and the like. Examples of the starch derivatives are hydroxyethyl starch, carboxymethyl starch, cyanoethylated starch and the like. Examples of the chlorinated resins are rubber chloride, chlorinated polyethylene, chlorinated polypropylenee and the like. These polymers are not sticky at an ambient temperature and have no bleed properties. The polymer material preferably has a glass transition temperature of more than 50° C. in view of the reliability of the printed images. In order to coil the polymer material into the paper matrix, the polymer material preferably has an average polymerization degree of 200 to 2,700, more preferably 200 to 1,500 or a flow softening point of 80 to 250° C., more preferably 80°to 200° C. The polymer material may further contain the fluorine-containing moisture curable resins or siloxane-containing moisture curable resins to decrease adhesive properties for the substrate. Since the polymer material layer is transferred to the image receive sheet together with the printing layer, it is preferred that the layer is transparent. Thus, the above mentioned component is preferably transparent. The polymer material layer 151 controls an adhesive properties between the substrate and image receiving layer or between the releasing layer and the image receiving layer, or functions as an undercoat for the image receiving layer. Once transferred onto the image receiving layer, the polymer material layer functions as a protective layer for light-resistance or wear resistance or exhibits good writing properties for pencils, because the layer is present the uppermost layer. The polymer material layer may be constituted from more than two layers and can be a coated or hot-molten layer or polymer film.

FIGS. 17–20 show sectional views of the transfer medium B of the present invention.

Figure 17:
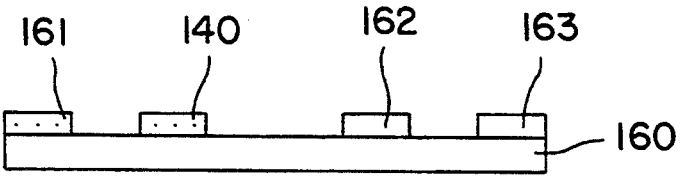
FIGS. 17–20 are sectional views which schematically show several embodiments of the transfer medium B of the present invention.
Figure 18:
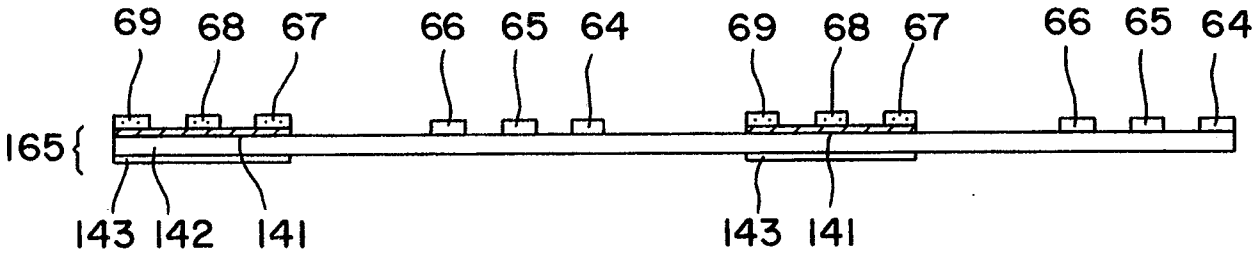
Figure 19:
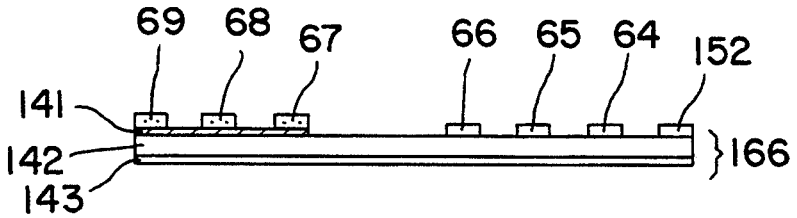
Figure 20:
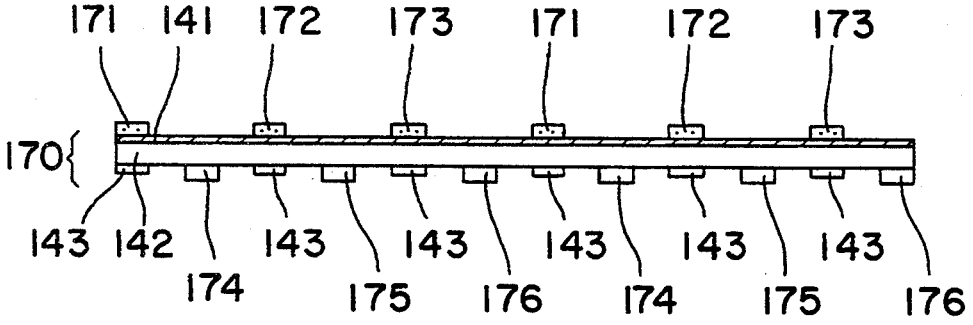

The transfer medium b at least comprises a substrate, image receiving layers and color ink layers. For example, as shown in FIG. 17, a substrate 160 has a cyan color ink layer 161, a black color ink layer 140, two image receiving layers 162 and 163 on the same side. As shown in FIG. 18, a substrate 165 contains a cyan, magenta and yellow color ink layers 69, 68 and 67 and three image receiving layers 66, 65 and 65 in this order. The substrate 165 also has an anchor coat layer 141 between the color ink layers and the substrate and a lubricant heat resistant layer 143. FIG. 19 shows a substrate 166 which contains a cyan, magenta and yellow color ink layers 69, 68 and 67, three image receiving layers 66, 65 and 64 and a functional layer 152 in this order. The substrate also has a lubricant heat resistant layer 143 on the back side and the anchor coat layer 141 is present between the substrate and the color ink layers. As shown in FIG. 20, a substrate 170 may have cyan, magenta and yellow color ink layers, 171, 172, 173 on one side in this order and image receiving layer 174, 175 and 176 on the other side in this order. The substrate 170 also has the continuous anchor coat layer 141 between the substrate and the color ink layers, and has a lubricant heat resistant layers 143 at the back side of the color ink layers. The explanation of each layer, such as color ink layer, image receiving layer, polymer material layer and the like are the same in the transfer medium A and therefore omitted.

The imaging sheet is not limited in raw material, properties and shape, and can be non-coated paper, coated paper, film, sheet, synthetic paper, continuous receive sheet or cut receive sheet.

The image formed on the imaging sheet, when transferred odd number, is a mirror image. Accordingly, it is noted that the printing by the recording head is conducted in consideration of the mirror image.

The images has been formed on the imaging sheet by transferring each color image layer one by one, so as to resemble to silver salt photograph. Accordingly, each color light having different optical path difference enters into people's eye and one feel it deep image. The color dye of the image is invaded into the imaging sheet and no color dye remains on the surface of the imaging sheet. Also, the upper image may protect the image which is present below the upper image, so that the below image may contain dyestuff which has low light resistance. The present invention can separate the dyestuffs which show light catalytic fading with each other, by each layer so as to decrease efficiently catalytic fading. The functional layer which contains ultraviolet absorber and the like can be formed on the surface of the imaging sheet or between the layers, like photographic paper, so as to significantly increase light stability.

The present invention provides the thermal printing method, the intermediate medium or the transfer medium which is capable of printing deep images having high light stability on any kinds of substrates, including plain paper, transparent film for OHP, bond paper having surface roughness, coated paper and coated film, without back diffusion or dye.

EXAMPLES

The present invention is illustrated by the following Examples which, however, are not to be construed as limiting the present invention to their details.

EXAMPLE 1

Preparation of Transfer Medium A

A polyethylene terephthalate (hereinafter "PET") film with 6 micrometer thickness and 200 mm width, had a lubricate heat resistance layer on one side and an anchor layer on the other side. On the anchor layer, the color ink layers were formed by coating with three color paints in the order of cyan, magenta and yellow. The color ink layers has 200 mm width, 250 mm length and an interval of 100 mm.

Cyan color paint

| Ingredients | Parts by weight |
|---|---|
| Indoaniline disperse dye | 3 |
| Acrylonitrile-styrene copolymer | 4 |
| Amide-modified silicone oil | 0.04 |
| Toluene | 25 |
| 2-Butanone | 25 |

Magenta color paint

| Ingredients | Parts by weight |
|---|---|
| Azo disperse dye | 3 |
| Acrylonitrile-styrene copolymer | 4 |
| Amide-modified silicone oil | 0.04 |
| Toluene | 25 |
| 2-Butanone | 25 |

Yellow color paint

| Ingredients | Parts by weight |
|---|---|
| Dicyanomethine disperse dye | 2.5 |
| Vinyl chloride-vinyl acetate copolymer resin*1 | 4 |
| Amide-modified silicone oil | 0.04 |
| Toluene | 25 |
| 2-Butanone | 25 |

*1Available from Sekisui Chemical Co., Ltd. as S-LEC C

Preparation of Intermediate Layer

The PET film having 12 micrometer thickness and 200 mm width was coated by a gravure coater with a paint prepared from the following ingredients to form image receiving layers having 1 micrometer thickness, about 200 mm width and 250 mm length at an interval of 100 mm

| Ingredients | Parts by weight |
|---|---|
| Polyvinyl butyral resin*2 | 4 |
| Siloxane containing acryl silicon resin solution*3 | 0.31 |
| Di-n-butyltin dilaurate | 0.002 |
| Toluene | 18 |
| 2-Butanone | 18 |

*2Available from Sekisui Chemical Co., Ltd. as BH-S having polmerization degree of 350.
*3Available from Sanyo Chemical Industries Ltd. as F-6A having effective components of 54 wt %.

The resulting sheet was contacted with the transfer medium so that each color ink layer was heaped with each image receiving layer, and then sandwiched between a thermal head and a platen roller under a pressure of about 3 Kg. Printing starts with cyan, then magenta and yellow and the image formed was gradation pattern of monocolor, two colors and three colors. Printing was conducted by the following conditions;

| | |
|---|---|
| Printing rate | 33.3 ms/line |
| Printing pulse width | 0–8 ms |
| Maximum printing energy | 6 J/cm$^2$ |

After printing, the transfer medium was peeled from the intermediate medium, but no heat fusion was seen and the images of monocolor was clearly reproduced in the image receiving layers.

Subsequently, a plain paper (wood free paper; A4 size) was heaped on the cyan image receiving layer and passed at about 180° C. between a silicone rubber covered metal roller (rubber hardness of 60°) and a metal roller under a pressure of about 5 Kg. The PET substrate sheet was removed to find that the cyan image receiving layer was adhered on the plain paper. The other color image receiving layers were then transferred in the order of magenta and then yellow onto the plain paper as generally described above, excepting that the image to be transferred was faithfully fit the printed images. Accordingly, cyan, magenta and yellow image receiving layers were transferred onto the plain paper to form a full color image. The hue of image was almost the same as that of printed image from mixed ink of each dye, because of no retransferring of dye.

EXAMPLE 2

A portrait image was printed as generally described above, with the exception that a white Pet sheet having about 70 micrometer thickness was employed instead of the plain paper. The resulting image has good depth in visual.

EXAMPLE 3

The printing was conducted as generally described in EXAMPLE 1, with the exception that two color images, i.e. cyan and yellow images, were merely formed on a plain paper. The light resistance of the resulting mixed color (green) image was evaluated by a xenon fade meter to find that the resulting image reduces half the change amount of color differences in comparison with the conventional image that obtained by printing two color images in one image receiving layer.

EXAMPLE 4

The imaging sheet obtained in Example 1 having a full color image was passed between heat rollers under a pressure of about 150 Kg at 180° C. to fix the image receiving layer. Accordingly, the three image receiving layers were pressured into the fibers of the plain paper and gloss which comes from the three image receiving sheet disappears. In the surface of the plain paper, there are no difference between the paper surface having no images and the image portion surface. The resulting image kept high quality.

EXAMPLE 5

Three image receiving layers (cyan, magenta and yellow) on the paper was obtained as generally described in Example 1, with the exception that bond paper was employed instead of plain paper. The bond paper was passed between the heat rollers under a pressure of about 120 Kg at 180° C. Accordingly, the three image receiving layers were pressured into the fibers of the plain paper and gloss which comes from the three image receiving sheet disappears. In the surface of the plain paper, there are no difference between the paper surface having no images and the image portion surface. The resulting image kept high quality.

EXAMPLE 6

Transfer medium A obtained in Example 1 was employed.

Preparation of Intermediate Layer

The PET film having 12 micrometer thickness and 200 mm width was coated by a wire bar with a paint prepared in Example 1 form a first image receiving layer having about 1.5 micrometer thickness, 200 mm width and 250 mm length. Then, a silicone rubber releasing layer having about 1 micrometer thickness, 200 mm width and 700 mm length was formed on the PET film 50 mm apart from the first image receiving layer. The silicone rubber releasing layer was prepared by coating a paint containing 10 parts by weight silicone releasing agent (available from Toray Dow Corning Silicone Co., Ltd. as PRX 305) and 10 parts by weight of toluene with a wire bar and then drying at 100° C. for one hour. On this releasing layer, a second having about 1.5 micrometer, 200 mm width and 250 mm length was formed 100 mm apart from the first image receiving layer. A third image receiving layer was prepared on the releasing layer 100 apart from the second image receiving layer.

The transfer medium was contacted with the intermediate medium obtained above and three color images were printed on the first (cyan), second (magenta) and third (yellow) image receiving layers. The three image receiving layers are kept fixed on the intermediate medium during and after printing. The intermediate medium was turned up to face the cyan image receiving layer with the magenta image receiving layer, and then passed between the heat rollers under about 5 Kg as described in Example 1. As the result, the magenta image receiving layer was successfully transferred onto the cyan image receiving layer. Subsequently, the yellow image receiving layer was faced with the cyan and magenta laminated image receiving layer and transferred as generally described above to form three color laminated image receiving layer on the intermediate medium.

EXAMPLE 7

The intermediate medium having the three color laminated image receiving layer, obtain in Example 6, was piled on a sheet of plain paper and passed between the heat roller under a pressure of about 5 Kg to transfer the three color laminated image receiving layer onto the paper.

EXAMPLE 8

Transfer medium A obtained in Example 1 was employed.

Preparation of Intermediate Layer

The PET film having 12 micrometer thickness and 200 mm width was coated with a releasing paint prepared in Example 6 to form a silicone rubber releasing layer having about 1 micrometer. On the releasing layer, image receiving layers having about 1.5 micrometer thickness, 200 mm width and 250 mm length were formed in an interval of 100 mm with a paint prepared in Example 1.

The transfer medium was contacted with the intermediate medium obtained above and three color images were printed on the first (cyan), second (magenta) and third (yellow) image receiving layers. The three image receiving layers are kept fixed on the intermediate medium during and after printing. A second intermediate medium (PET film) having 9 micrometer thickness and 210 mm width was employed in combination with the above (first) intermediate medium. The cyan image receiving layer on the first intermediate medium was faced with the second intermediate medium and passed between the heat rollers under a pressure of about 5 Kg as described in Example 1 to transfer the cyan image receiving layer onto the second intermediate medium. As generally described above, the magenta and yellow image receiving layers were transferred onto the different portion of the second intermediate layer.

Subsequently, the obtained second intermediate medium having three color image receiving layers in different portion was passed between the heat rollers under a pressure of about 5 Kg together with a sheet of plain paper, as generally described in Example 1 to form a full color image on the paper sheet.

EXAMPLE 9

Transfer medium A obtained in Example 1 was employed.

Preparation of Intermediate Layer

The PET film having 12 micrometer thickness and 200 mm width was coated with a paint prepared in Example 1 form three image receiving layers having about 1.5 micrometer thickness, 200 mm width and 250 mm length at an interval of 100 mm. At the position 100 mm apart from the third image receiving layer, a colorless transparent function layer having about 1.5 micrometer thickness, 200 mm width and 250 mm length was formed from a ultraviolet absorbing paint as follow.

| Ingredients | Parts by weight |
|---|---|
| Polyvinyl butyral resin*2 | 4 |
| Siloxane containing acryl silicon resin solution*3 | 0.31 |
| Di-n-butyltin dilaurate | 0.002 |
| Benzotriazole ultraviolet absorbent | 0.2 |
| Toluene | 18 |
| 2-Butanone | 18 |

The transfer medium was contacted with the intermediate medium obtained above and three color images were printed on the cyan, magenta and yellow image receiving layers. The intermediate medium was faced with a sheet or plain paper and passed between the heat rollers under a pressure of about 5 Kg at 180° C. as generally described in Example to form three color laminated image receiving layers on the paper sheet. Finally, the remaining functions layer was also transferred onto the yellow image receiving layer on the paper sheet to obtain a full color image on which a ultraviolet absorbing layer was present. The light resistance of the resulting full color image was evaluated by a xenon fade meter to find that the resulting image reduces half the change amount of color difference in comparison with the conventional image that obtained by printing three color images in one image receiving layer.

EXAMPLE 10

Preparation of Transfer Medium B

The PET film with 6 micrometer thickness and 200 mm width, had lubricate heat resistance layer (2.5 micrometer thickness, 200 mm width and 250 mm length) on one side at an interval of 450 mm and an anchor layer (0.1 micrometer thickness) on the other side. On the interval portion (i.e. no lubricate heat resistance layer portion), a paint prepared from the following ingredients was coated by a wire bar and dried to obtain image receiving layers having about 1.5 micrometer, 200 width and 250 mm length. The interval between the lubricate heat resistance layers and the image receiving layers is set 100 mm.

| Ingredients | Parts by Weight |
|---|---|
| Polyvinyl butyral resin*4 | 4 |
| Siloxane containing acryl silicon resin solution*3 | 0.31 |
| Di-n-butyltin dilaurate | 0.002 |
| Toluene | 18 |
| 2-Butanone | 18 |

*4Available from Sekisui Chemical Co., Ltd. as BM-2 having an average polymerization degree of about 800.

The anchor coat layer which corresponds to the lubricate heat resistance layers was coated with color ink paint as generally described in Example 1 to form cyan, magenta and yellow color ink layers having about 1 micrometer, 200 mm width, 250 mm length and about 450 mm interval.

Then, the transfer medium was spirally wound as shown in FIG. 6 and the cyan color ink layer was faced with the image receiving layer. It was passed between a thermal head and a platen and printed as generally described in Example 1. The thermal had and the platen were separated and the transfer medium was moved so that the magenta color ink layer and the other image receiving layer were sandwiched between the thermal head and the platen. Then, printing of the magenta image was conducted. The yellow image also formed as mentioned above.

Subsequently, a plain paper was heaped on the cyan image receiving layer and passed at about 180° C. between a heat rollers as generally described in Example 1 under a pressure of about 5 Kg. The other color image receiving layers were then transferred in the order of magenta and then yellow onto the plain paper as generally described above, excepting that the image to be transferred was faithfully fit the printed images. Accordingly, cyan, magenta and yellow image receiving layers were transferred onto the plain paper to form a full color image.

What is claimed is:

1. A thermal dye transfer printing method comprising:

transferring each color image by printing head from a transfer medium A onto an intermediate medium wherein said transfer medium A has at least one color ink block consisting of color ink layers each of which contains different color ink, said intermediate medium has image receiving layers, whereby each image receiving layer on the intermediate medium contains one color image, and transferring each color image receiving layer onto an imaging sheet from the intermediate medium, so that one image receive portion of the imaging sheet contains the image receiving layers corresponding to one color ink block, and fixing said image receiving layers on the imaging sheet by heat and/or pressure.

2. The thermal dye transfer printing method according to claim 1 wherein, before transferring each color image receiving layer onto the imaging sheet, each color image receiving layer is preliminary transferred onto another color image receiving layer on the intermediate medium to form a color laminated image receiving layer with one color image receiving layer superimposed on the other.

3. The thermal dye transfer printing method according to claim 2 wherein said color laminated image receiving layer is transferred onto the imaging sheet.

4. The thermal dye transfer printing method according to claim 1 wherein, before transferring each color image receiving layer onto the imaging sheet, each color image receiving layer of the intermediate medium is once transferred onto a second intermediate medium, and then transferred onto the imaging sheet from the second intermediate medium.

5. The thermal dye transfer printing method according to claim 1 wherein said image receiving layer has been formed by transferring.

6. The thermal dye transfer printing method according to claim 1 wherein a transfer medium B having both image receiving layers and color ink layers at different positions is employed instead of the the transfer medium A, and said intermediate medium receives image receiving layers from the transfer medium B.

7. The thermal dye transfer printing method according to claim 1 wherein the layers present on both said transfer medium A and said intermediate medium are formed on one substrate at different locations along the substrate on the same side and printed such as to form a transfer medium B' within which each color image is transferred on each image receiving layer, and then the color image receiving layer is transferred onto the imaging sheet.

8. The thermal dye transfer printing method according to claim 7 wherein, before transferring each color image receiving layer onto the imaging sheet, each color image receiving layer is preliminary transferred onto another color image receiving layer on the transfer medium B to form a color laminated image receiving layer.

9. The thermal dye transfer printing method according to claim 8 wherein said color laminated image receiving layer is transferred onto the imaging sheet.

10. The thermal dye transfer printing method according to claim 7 wherein, before transferring each color image receiving layer onto the imaging sheet, each color image receiving layer of the transfer medium B is once transferred onto a second intermediate medium, and then transferred onto the image sheet from the second intermediate medium.

11. The thermal dye transfer printing method according to claim 1 wherein each image receiving layer is individually fixed on the imaging sheet by heat and/or pressure.

12. The thermal dye transfer printing method according to claim 1 wherein said image receiving layer is transferred onto the imaging sheet without printing any image.

13. The thermal dye transfer printing method according to claim 1 wherein said color ink layers are either sublimable or heat meltable or both.

14. The thermal dye transfer printing method according to claim 1 wherein said image receiving layer is formed from polyvinyl acetal.

15. The thermal dye transfer printing method according to claim 1 wherein said image receiving layer is formed from a polymer having a flow softening temperature of 250° C. or less.

* * * * *